United States Patent [19]

Wilson

[11] Patent Number: 4,656,895

[45] Date of Patent: Apr. 14, 1987

[54] EMERGENCY GAS SHUT-OFF TOOL

[75] Inventor: Johnnie L. Wilson, Pasadena, Calif.

[73] Assignee: Erik M. Arnhem, a part interest

[21] Appl. No.: 700,496

[22] Filed: Feb. 11, 1985

[51] Int. Cl.[4] ..... B25B 13/00; B25B 13/30; B25G 1/00

[52] U.S. Cl. ..... 81/177.8; 81/111; 7/166; 7/168

[58] Field of Search ..... 7/138, 151, 166, 170, 7/168; 81/124.3, 124.7, 177.7, 177.6, 98, 177.8, 111; 206/376, 377, 378

[56] References Cited

U.S. PATENT DOCUMENTS

| | | | |
|---|---|---|---|
| 65,550 | 6/1867 | Dunlap | 81/124.5 |
| 120,304 | 10/1871 | McBride | 81/177.8 |
| 510,981 | 2/1893 | Massey | 7/138 |
| 763,745 | 6/1904 | Gheen | 7/138 |
| 770,970 | 9/1904 | Keferstein | 7/168 |
| 773,428 | 10/1904 | Sickles | 7/138 |
| 941,707 | 11/1909 | Gaines | 81/177.8 |
| 1,060,494 | 4/1913 | Reynolds | 81/177.8 |
| 1,811,137 | 6/1931 | Kress | 81/177.9 |
| 1,840,685 | 1/1932 | Witherup | 81/177.8 |
| 2,669,147 | 2/1954 | Koenig | 81/119 |
| 2,680,983 | 6/1954 | Miller | 81/60 |
| 2,886,998 | 5/1959 | Scott | 81/177.7 |
| 2,978,938 | 4/1961 | Nalley | 81/177.8 |
| 4,084,456 | 4/1978 | Pasbrig | 81/98 |
| 4,269,311 | 5/1981 | Rich | 81/177.6 |
| 4,371,021 | 2/1983 | Converse et al. | 7/151 |

FOREIGN PATENT DOCUMENTS

| | | | |
|---|---|---|---|
| 3133481 | 3/1983 | Fed. Rep. of Germany | 81/111 |
| 168843 | 7/1934 | Switzerland | 7/168 |

*Primary Examiner*—Frederick R. Schmidt
*Assistant Examiner*—Bradley I. Vaught
*Attorney, Agent, or Firm*—Erik M. Arnhem

[57] ABSTRACT

Emergency gas shut-off tool; comprising a three-dimensional shank, having an upper end terminating in a butt and an inverted U-shaped three-dimensional head mounted rotatably to the shank adjacent the butt so as to form a closed space therewith.

9 Claims, 4 Drawing Figures

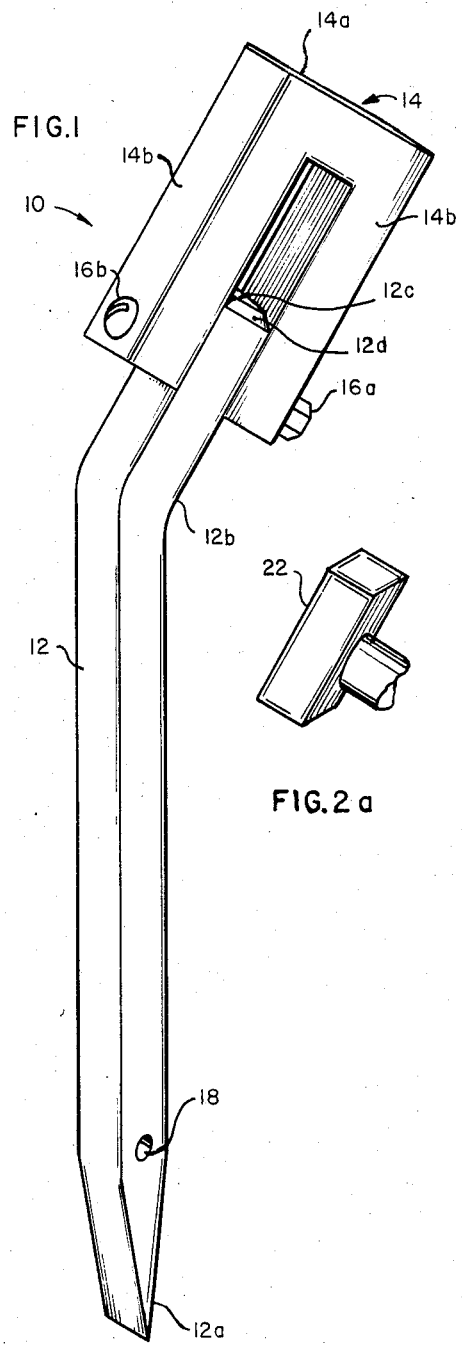
FIG.1
FIG.2a
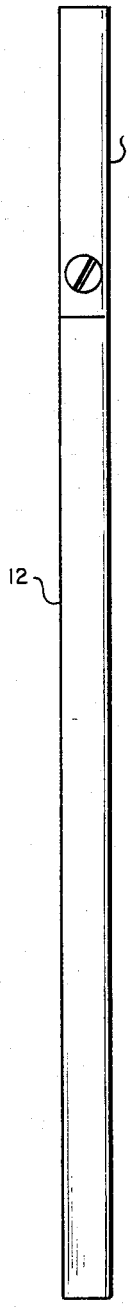
FIG. 2
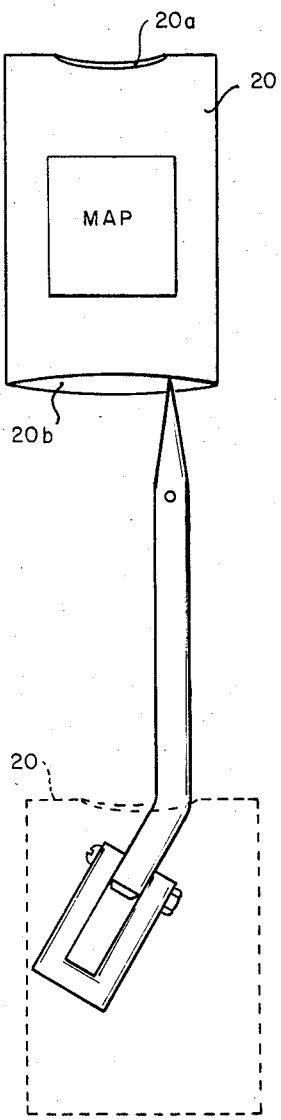
FIG. 3

EMERGENCY GAS SHUT-OFF TOOL

BACKGROUND OF THE INVENTION (1) Field of the Invention

My invention refers to a manual tool, especially adapted to quickly grip and turn off the main gas valve, which controls the supply of gas to single homes, apartment buildings, etc.

The tool is of particular importance to areas which are known to experience earthquakes or movements of earth, such as e.g., the State of California.

(2) Prior Art

The following U.S. patents are listed as being of general interest with respect to my invention:

| | | | |
|---|---|---|---|
| No: | 66,550 | DUNLAP | 1867 |
| | 1,060,494 | REYNOLDS | 1913 |
| | 1,811,137 | KRESS | 1930 |
| | 2,978,938 | NALLEY | 1961 |
| | 120,304 | McBRIDE | 1871 |
| | 941,707 | GAINES | 1909 |
| | 1,840,685 | WITHERUP | 1929 |
| | 2,669,147 | KOENIG | 1953 |

DUNLAP discloses a wrench with a pivotal die B.

REYNOLDS, KRESS and NALLEY show tools with pivoting jaw members.

McBRIDE, GAINES, WITHERUP and KOENIG are cited as being of interest with respect to the construction of handle members of various tools.

None of the above cited patents discloses an inverted U-shaped head, rotatably supported by a "straight" handle.

SUMMARY OF THE INVENTION

In addition to what was stated under Background of the invention above, the tool, according to the invention is, particularly suited for emergency or life threatening situations when the possibility of a gas explosion is imminent, such as when an earthquake occurs, a fire breaks out, etc. Under such circumstances, quick action is of utmost importance.

The tool is so dimensioned, that it will virtually fit all conventional gas valves, whether located in private homes, apartment buildings, factories, etc. A typical example of such a valve is shown schematiccaly in FIG. 2*a*.

Furthermore, the tool may be applied to variable sizes of gas valves, without adjustment as, generally is necessary when using a conventional wrench.

The tool, according to the invention is designed for leverage, so that the user can cause the head of the tool to turn by a 180 degree rotation with little effort, in order to position same for turning off the gas valve.

By virtue of its pivoting head, its bent handle and bevelled top edges, the tool may be handled by an inexperienced or elderly person, who may be able to get to the valve, even when it is rather inaccessible because of pipes extending adjacent to the valve etc., turn off the valve and release the head of the tool from the latter.

It is, thus an object of the invention to provide a life saving tool adaptable to quickly gripping and turning off a gas valve.

It is a further object to provide such a tool, which may be handled with little effort by almost anyone.

BRIEF DESCRIPTION OF THE DRAWINGS

FIG. 1 is a perspective view of the tool for turning off a gas valve according to the invention.

FIG. 2 is an elevational side view of the tool.

FIG. 2*a* is a perspective view of a gas cock.

FIG. 3 shows a frangmentary front elevational view of the tool in conjunction with a cover for its head.

DESCRIPTION OF THE INVENTION

In the drawings like reference characters designate similar parts in the several views of the drawings.

In FIG. 1, numeral 10 indicates the tool in its entirety. Handle 12 of tool 10 is partially straight, and preferably of three-dimensional rectangular configuration; its free end 12*a* is pointed and apertured at 18. The other end portion 12*b* of handle 12 extends angularly relative to the straight portion thereof. The top of end portion 12*b* terminates in a square butt 12*c*. The head 14 of the tool is constituted as an inverted U of three-dimensional rectangular shape, i.e., having a shoulder 14*a* and two arms 14*b*, of substantially the same width and depth as handle 12. Head 14 is mounted, as illustrated in FIG. 1, rotatably at the free ends of its arms 14*b*, to and abutting opposite sides of handle portion 12*b* by way of pivoting means, e.g., bolt/nut connection 16*a* and 16*b*. The free edges of butt 12*c* are bevelled at 12*d*, in order to facilitate the engagement of tool head 14 with and release from a gas valve or cock (FIG. 2*a*). The pointed end 12*a* is intended for use as a pry to pry open locked doors, jammed locks, windows, etc.

Gas shut-off valves, in general, whether of the industrial or residential type, are rectangularly shaped; the largest dimensions of these valves are somewhat smaller than the internal rectangular space between the arms 14*b* of head 14 and butt 12*c* of the tool.

The preferred dimensions of the space within head 14 are 2-2/6"×$\frac{5}{8}$" and would, therefore fit over any known gas valves, which, for homes ranges from $\frac{3}{4}$"×$\frac{1}{4}$", $\frac{7}{8}$"×$\frac{1}{2}$" to $1\frac{1}{4}$"×$\frac{1}{2}$", for industrial buildings from $\frac{1}{2}$"×$\frac{5}{8}$", $1\frac{3}{4}$"×$\frac{5}{8}$" to 2×5/7".

As noted above the head of the tool, according to the invention, needs no adjustment, because it will universally fit existing types of valves.

Furthermore, the tool head 14 is turnable from one side of shank 12 onto the opposite side thereof i.e. by at least 180° and shank 12 is angled, these features in combination will greatly facilitate securing easy access to a valve located within a narrow space, e.g., between crossing pipes, adjacent to a wall, etc.

In so manipulating tool 10, and causing it to engage with a valve to be turned off (FIG. 2*a*) the purpose of the tool is accomplished.

Even hard to turn, e.g., rusty valves would pose no problems, when using proper leverage manually and/or with a foot.

As it appears from the drawings, head 14 of tool 10 is not held between a bulky bifurcated shank, thus possibly preventing the user from gaining access to a valve within a narrow space, but—to the contrary—shank 12 is mounted movable between the ends of head 14.

The overall preferred dimensions of tool 10 are as follows:

Total length of shank 12: 12"
Width of arms 14*b* of head 14: 5/16"
Depth of head 14: 158 "
Height of head 14: $3\frac{1}{8}$"
Length of head 14: $1\frac{3}{4}$"

The width and depth of shank 12 is substantially similar to those of head 14.

FIG. 3 illustrates tool 10 ready to be hung e.g., on a kitchen wall, partially covered by a rather flat bag 20; the latter is preferably of rectangular shape, having an upper narrow opening 20*a* at its top, and a wide opening 20*b* at its bottom. As indicated in FIG. 3, bag 20 is dropped over tool shank 12 and will come to rest on the shoulder of head 14 (as shown by dotted lines). The front panel of bag 20 is intended to provide space for general outline of a house map, which then may be supplemented by specific information on where the gas valve is located. Such information could be invaluable, especially for strangers or elderly persons, when minutes count before a possible explosion may occur.

The cover bag 20 could be made of paper or plastic material, the latter is preferable if the tool is hung outside a house as protection against rain, etc.

While the foregoing has illustrated and described what is now contemplated to be the best mode of carrying out the invention, the description is, of course, subject to modifications without departing from the spirit and scope of the invention. Therefore, it is not desired to restrict the invention to the particular construction illustrated and described, but to cover all modifications that may fall within the scope of the appended claims.

I claim:

1. An emergency gas valve turning tool, comprising in combination (a) an elongated three-dimensional rectangularly shaped shank having an upper end terminating in a butt;

(b) a head, comprising two arms each said arm having a free end, and a shoulder connecting said two arms, forming a three-dimensional rectangular inverted U-shape each free end of said arms being, rotatably mounted by pivoting means to an opposite side of the shank adjacent the butt thereof, said butt, said two arms and said shoulder cooperating to form a closed rectangular space, within which a gas valve may be captivated.

2. A tool, according to claim 1, wherein the widths and depths of the head is substantially similar to those of the shank.

3. A tool, according to claim 1, wherein the head is mounted to the shank by means of a bolt and nut connection.

4. A tool, according to claim 1, wherein edges of the butt of the shank are bevelled.

5. A tool, according to claim 1, wherein the head is turnable by at least 180° relative to the shank.

6. A tool, according to claim 1, wherein the shank is angled.

7. A tool, according to claim 1, wherein the lower end of the shank is apertured for hanging upside down on a support.

8. A tool, according to claim 7, provided with a panelled bag having a narrowly aperture top and a widely apertured bottom, the bag being slipped from the lower end down over the shank so as to rest on the shoulder of and covering the head of the tool when not in use.

9. A tool, according to claim 7, wherein at least an outline of a house map is printed on one of the panels of the bag.

* * * * *